US008157932B2

(12) United States Patent
Yan et al.

(10) Patent No.: US 8,157,932 B2
(45) Date of Patent: Apr. 17, 2012

(54) AL-ZN-MG-CU-SC HIGH STRENGTH ALLOY FOR AEROSPACE AND AUTOMOTIVE CASTINGS

(75) Inventors: Xinyan Yan, Murrysville, PA (US); Jen C. Lin, Export, PA (US); Cagatay Yanar, Bethel Park, PA (US); Larry Zellman, Yorktown, VA (US); Xavier Dumant, Laval (FR); Robert Tombari, Quebec (CA); Eric Lafontaine, Quebec (CA)

(73) Assignee: Alcoa Inc., Pittsburgh, PA (US)

( * ) Notice: Subject to any disclaimer, the term of this patent is extended or adjusted under 35 U.S.C. 154(b) by 364 days.

(21) Appl. No.: 11/439,368

(22) Filed: May 23, 2006

(65) Prior Publication Data

US 2007/0017604 A1 Jan. 25, 2007

Related U.S. Application Data

(60) Provisional application No. 60/684,469, filed on May 25, 2005.

(51) Int. Cl.
*C22C 21/10* (2006.01)

(52) U.S. Cl. ..... 148/417; 420/532

(58) Field of Classification Search ..... 148/417; 420/532

See application file for complete search history.

(56) References Cited

U.S. PATENT DOCUMENTS

| | | | | |
|---|---|---|---|---|
| 3,619,181 | A | 11/1971 | Willey | 75/138 |
| 3,741,827 | A | 6/1973 | Reynolds et al. | 148/701 |
| 3,762,916 | A | 10/1973 | Kirman | 148/693 |
| 4,711,762 | A | 12/1987 | Vernam et al. | 420/532 |
| 4,830,826 | A | 5/1989 | Ichiro | 420/532 |
| 5,135,713 | A | 8/1992 | Rioja et al. | 420/532 |
| 5,211,910 | A | 5/1993 | Pickens et al. | 420/532 |
| 5,334,266 | A | 8/1994 | Kawanishi et al. | 148/403 |
| 5,597,529 | A | 1/1997 | Tack | 420/532 |
| 6,027,582 | A | 2/2000 | Shahani et al. | 148/417 |
| 6,048,415 | A | 4/2000 | Nakai et al. | 148/417 |
| 6,145,466 | A | 11/2000 | Herbein et al. | 114/356 |
| 6,182,591 | B1 | 2/2001 | Whitesides et al. | 114/83 |
| 6,231,809 | B1 | 5/2001 | Matsumoto et al. | 420/535 |
| 6,231,995 | B1 | 5/2001 | Yamashita et al. | 428/598 |
| 6,302,973 | B1 | 10/2001 | Haszler et al. | 148/437 |
| 6,308,999 | B1 | 10/2001 | Tan et al. | 293/109 |
| 6,314,905 | B1 | 11/2001 | Herbein et al. | 114/356 |
| 6,338,817 | B2 | 1/2002 | Yamashita et al. | 420/545 |
| 6,458,224 | B1 | 10/2002 | Ren et al. | 148/437 |
| 6,508,035 | B1 | 1/2003 | Seksaria et al. | 49/502 |
| 6,711,819 | B2 | 3/2004 | Stall et al. | 29/898.14 |
| 6,769,733 | B2 | 8/2004 | Seksaria et al. | 296/192 |
| 6,783,730 | B2 | 8/2004 | Lin et al. | 420/550 |
| 6,808,003 | B2 | 10/2004 | Raghunathan et al. | 164/98 |
| 6,848,233 | B1 | 2/2005 | Haszler et al. | 52/783.17 |
| 6,855,234 | B2 | 2/2005 | D'Astolfo et al. | 204/280 |
| 6,884,637 | B2 | 4/2005 | Umemura et al. | 438/14 |
| 2001/0028860 | A1 | 10/2001 | Fang et al. | 420/532 |
| 2001/0028861 | A1 | 10/2001 | Fang et al. | 420/532 |
| 2001/0039982 | A1 | 11/2001 | Sigli et al. | 148/550 |
| 2002/0011289 | A1 | 1/2002 | Warner | 148/437 |
| 2002/0150498 | A1 | 10/2002 | Chakrabarti et al. | 420/532 |
| 2002/0162609 | A1 | 11/2002 | Warner | 148/439 |
| 2003/0030181 | A1 | 2/2003 | Raghunathan et al. | 264/280 |
| 2003/0085579 | A1 | 5/2003 | Seksaria et al. | 293/133 |
| 2003/0085591 | A1 | 5/2003 | Seksaria et al. | 296/193.04 |
| 2003/0085592 | A1 | 5/2003 | Seksaria et al. | 296/187.09 |
| 2003/0089545 | A1 | 5/2003 | Seksaria et al. | 180/312 |
| 2003/0090128 | A1 | 5/2003 | Seksaria et al. | 296/192 |
| 2003/0152478 | A1 | 8/2003 | Lin et al. | |
| 2003/0205916 | A1 | 11/2003 | Seksaria et al. | 296/192 |
| 2003/0219353 | A1 | 11/2003 | Warner et al. | 420/532 |
| 2004/0079198 | A1 | 4/2004 | Bryant et al. | 75/415 |
| 2004/0089378 | A1* | 5/2004 | Senkov et al. | 148/417 |
| 2004/0089382 | A1 | 5/2004 | Senkov et al. | 148/701 |
| 2004/0107823 | A1 | 6/2004 | Kiley et al. | 86/50 |
| 2004/0115087 | A1* | 6/2004 | Axenov et al. | 420/532 |
| 2004/0163492 | A1 | 8/2004 | Crowley et al. | 75/415 |
| 2004/0183339 | A1 | 9/2004 | Seksaria et al. | 296/203.02 |
| 2004/0261916 | A1 | 12/2004 | Lin et al. | |
| 2005/0008890 | A1 | 1/2005 | Raghunathan et al. | 428/613 |
| 2005/0034558 | A1 | 2/2005 | Amick | |
| 2005/0034794 | A1 | 2/2005 | Benedictus et al. | 148/552 |
| 2005/0056353 | A1 | 3/2005 | Brooks et al. | 148/549 |
| 2005/0072497 | A1 | 4/2005 | Eberl et al. | 148/439 |
| 2005/0238528 | A1* | 10/2005 | Lin et al. | 420/532 |

FOREIGN PATENT DOCUMENTS

| | | | |
|---|---|---|---|
| CA | 2609257 | | 11/2006 |
| EP | 1 205 567 | | 5/2002 |
| EP | 1885898 | | 2/2008 |
| FR | 2 853 666 | | 10/2003 |
| GB | 2415203 | | 12/2005 |
| JP | 48007822 | A * | 1/1973 |
| JP | 52-009602 | | 3/1977 |
| JP | 359118865 | | 7/1984 |
| JP | 60145365 | | 7/1985 |
| JP | 360180637 | | 9/1985 |
| JP | 360194041 | | 10/1985 |
| JP | 62-250149 | A | 10/1987 |
| JP | 62250149 | | 10/1987 |
| SU | 559984 | | 7/1977 |
| SU | 559984 | A * | 7/1977 |
| WO | WO 96/10099 | | 4/1996 |
| WO | 2004046402 | | 6/2004 |
| WO | WO 2004/046402 | A2 | 6/2004 |
| WO | WO 2004/090185 | | 10/2004 |
| WO | 2006127812 | | 11/2006 |

OTHER PUBLICATIONS

'Aluminum and Aluminum Alloys', ASM International, 1993, p. 41.*

(Continued)

*Primary Examiner* — Roy Kind
*Assistant Examiner* — Janelle Morillo
(74) *Attorney, Agent, or Firm* — Greenberg Traurig, LLP

(57) ABSTRACT

An aluminum casting alloy, comprises, in weight percent, about 4-9% Zn; about 1-4% Mg; about 1-2.5% Cu; less than about 0.1% Si; less than about 0.12% Fe; less than about 0.5% Mn; about 0.01-0.05% B; less than about 0.15% Ti; about 0.05-0.2% Zr; about 0.1-0.5% Sc; no more than about 0.05% each miscellaneous element or impurity; no more than about 0.15% total miscellaneous elements or impurities.

10 Claims, No Drawings

OTHER PUBLICATIONS

Grasso, P.D., et al., Hot Tear Formation and Coalescence Obersvations in Organic Alloys, JOM-e, Jan. 2002, http://www.tms.org/pubs/journals/JOM/0201/Grasso/Grasso-0201.html.
"ASM vol. 4 Heat Treating", ASM International, 1991, p. 850.
Kaufman, Gilbert et al., "Aluminum Alloy Castings: Properties, Processes, and Applications," ASM International, Dec. 2004.
Chemical Composition Limits, pp. 10-12, Aluminum Association Teal Sheets, 2009.

* cited by examiner

AL-ZN-MG-CU-SC HIGH STRENGTH ALLOY FOR AEROSPACE AND AUTOMOTIVE CASTINGS

This application claims benefits and priority of U.S. provisional application Ser. No. 60/684,469 filed May 25, 2005.

FIELD OF THE INVENTION

The present invention relates to alloy compositions and, more particularly, it relates to aluminum casting alloys for automotive and aerospace applications.

BACKGROUND OF THE INVENTION

Cast aluminum parts are widely used in the aerospace and automotive industries to reduce weight. The most common cast alloy used, Al—Si7-Mg has well established strength limits. At present, cast materials in A356.0, the most commonly used Al—Si7-Mg alloy can reliably guarantee Ultimate Tensile Strength of 290 MPa, Tensile Yield Strength of 220 MPa with elongations of 8% or greater. The typical tensile properties of Al—Si7-Mg type high-strength D357 alloy are Ultimate Tensile Strength of 350 MPa, Tensile Yield Strength of 280 MPa with elongations of 5% or greater. In order to obtain lighter weight parts, higher strength material is needed with established material properties for design.

A variety of aluminum alloys, mainly wrought alloys, exhibit higher strength. The challenge in casting of these alloys has been the tendency to form hot tears during solidification. Hot tears are macroscopic fissures in a casting as a result of stress and the associated strain, generated during cooling, at a temperature above the non-equilibrium solidus. In most cases, the castings cannot be salvaged for further processing because of the hot tears. These wrought alloys are not suitable for use as casting alloys. Therefore, it is preferred to have an alloy with mechanical properties close to or superior to those of high-strength wrought alloys and which also has good castability, corrosion resistance and other properties.

SUMMARY OF THE INVENTION

The invention provides of an Al—Zn—Mg—Cu base alloy for investment, low pressure or gravity permanent or semi-permanent mold, squeeze, high pressure die or sand mold casting with the following composition ranges (all in weight percent).

Zn: about 4 to about 9%;
Mg: about 1 to about 4%;
Cu: about 1 to about 2.5%;
Si: less than about 0.1%;
Fe: less than about 0.12%;
Mn: less than about 0.5%;
B: about 0.01 to about 0.05%;
Ti: less than about 0.15%;
Zr: about 0.05 to about 0.2%;
Sc: about 0.1 to about 0.5%;
no more than about 0.05% each miscellaneous element or impurity;
no more than about 0.15% total miscellaneous elements or impurities; and
Al: remainder.

The alloy after casting and heat treating to a T6 temper can achieve mechanical properties demonstrating more than 100% higher tensile yield strength than expected from A356.0-T6 while maintaining reasonable elongations.

In one aspect, the present invention is an aluminum alloy, the alloy including, in weight percent:
about 4 to about 9% Zn;
about 1 to about 4% Mg;
about 1 to about 2.5% Cu;
less than about 0.1% Si;
less than about 0.12% Fe;
less than about 0.5% Mn;
about 0.01 to about 0.05% B;
less than about 0.15% Ti;
about 0.05 to about 0.2% Zr;
about 0.1 to about 0.5% Sc;
no more than about 0.05% each miscellaneous element or impurity;
no more than about 0.15% total miscellaneous elements or impurities; and
remainder Al.

In another aspect, the present invention is a method of making an aluminum alloy casting, the method including:
preparing an aluminum alloy melt, the melt including, in weight percent:
about 4 to about 9% Zn;
about 1 to about 4% Mg;
about 1 to about 2.5% Cu;
less than about 0.1% Si;
less than about 0.12% Fe;
less than about 0.5% Mn;
about 0.01 to about 0.05% B;
less than about 0.15% Ti;
about 0.05 to about 0.2% Zr;
about 0.1 to about 0.5% Sc;
no more than about 0.05% each miscellaneous element or impurity;
no more than about 0.15% miscellaneous elements or impurities; and
remainder Al;
the method further including casting at least a portion of the melt in a mold configured to produce the casting;
removing the casting from the mold; and
subjecting the casting to a T6 heat treatment.

In an additional aspect, the present invention is an aluminum alloy casting, the casting including, in weight percent:
about 4 to about 9% Zn;
about 1 to about 4% Mg;
about 1 to about 2.5% Cu;
less than about 0.1% Si;
less than about 0.12% Fe;
less than about 0.5% Mn;
about 0.01 to about 0.05% B;
less than about 0.15% Ti;
about 0.05 to about 0.2% Zr;
about 0.1 to about 0.5% Sc;
no more than about 0.05% each miscellaneous element or impurity;
no more than about 0.15% total miscellaneous elements or impurities; and
remainder Al.

DETAILED DESCRIPTION OF PREFERRED EMBODIMENTS

The invention provides an Al—Zn—Mg—Cu base alloy for investment, low pressure or gravity permanent or semi-permanent mold, squeeze, high pressure die or sand mold casting with the following composition ranges (all in weight percent).

Laboratory scale tests were made on samples of alloys according to the invention. The alloys were cast in a directional solidification (DS) mold for mechanical properties evaluation. The castings from the DS mold possess microstructures from various cross-sections representing different cooling rates. The casting was heat treated to T6 condition.

Hot cracking resistance of the alloys was evaluated using the so called "Pencil Probe Mold". The pencil probe mold produced "I" shape castings with the connection rod diameters ranging from 16 mm to 2 mm. The hot cracking index is defined to be the diameter of the largest diameter rod that is cracked for that alloy. Therefore, a smaller HCI for a specific alloy indicates a greater hot cracking resistance for that alloy.

As shown in Table 1, the hot cracking index (HCI) was strongly affected by alloy composition and grain refining. Alloys which contain >0.15% Sc, >2.25% Mg and 0.02% B, show the best hot cracking resistance. The first alloy shown in the table, 7xx-7 is a prior art alloy for comparison. The alloy is the 7075 wrought alloy.

When a shaped casting is to be made from an alloy according to the present invention, a melt is prepared having a composition within the ranges specified in the claims. At least a portion of the melt is then cast in a mold configured to produce the casting. The casting is then removed from the mold and it is subjected to a T6 heat treatment in order to obtain maximum mechanical properties.

Samples of alloys according to the invention were investment cast and aged to evaluate tensile properties. Alloy 1 had a composition, in weight %, of 0.026% Si, 0.11% Fe, 1.64% Cu, 0.056% Mn, 2.53% Mg, 0.04% Cr, 0.01% Ni, 7.48% Zn, 0.06% Ti, 0.02% B, 0.0% Be, 0.12% Zr, 0.33% Sc and balance Al. Alloy 2 had a composition, in weight %, of 0.015% Si, 0.016% Fe, 1.52% Cu, 0.055% Mn, 2.34% Mg, 0.0% Cr, 0.0% Ni, 7.19% Zn, 0.06% Ti, 0.02% B, 0.0% Be, 0.14% Zr, 0.33% Sc and balance Al. The alloys 1 and 2 were cast at a temperature of 730 degrees C. into shell molds and solid plaster molds having a mold temperature of 800 degrees C.

TABLE 1

Alloy Composition

| | Composition, wt % | | | | | | | | | | |
|---|---|---|---|---|---|---|---|---|---|---|---|
| Alloy | Cu | Mg | Zn | Si | Fe | Mn | Ti | B | Zr | Sc | HCI (mm) |
| 7xx-7 | 1.6 | 1.5 | 7.5 | <0.1 | <0.1 | 0.45 | 0.06 | 0.02 | 0.12 | 0 | 16 |
| S01 | 1.62 | 1.5 | 7.66 | 0.03 | 0.04 | 0.12 | 0 | 0 | 0.13 | 0 | 16 |
| S02 | 1.62 | 1.5 | 7.66 | 0.03 | 0.04 | 0.12 | 0 | 0 | 0.13 | 0.15 | 16 |
| S03 | 1.62 | 1.5 | 7.66 | 0.03 | 0.04 | 0.12 | 0 | 0 | 0.13 | 0.3 | 16 |
| S04 | 1.62 | 1.5 | 7.66 | 0.03 | 0.04 | 0.12 | 0.06 | 0.02 | 0.13 | 0.3 | 14 |
| S05 | 1.62 | 2.5 | 7.66 | 0.03 | 0.04 | 0.12 | 0.06 | 0.02 | 0.13 | 0.3 | 8 |
| S06 | 1.62 | 3.5 | 7.66 | 0.03 | 0.04 | 0.12 | 0.06 | 0.02 | 0.13 | 0.3 | 8 |
| N01 | 1.58 | 2.46 | 7.37 | 0.04 | 0.05 | 0.11 | 0.06 | 0.02 | 0.12 | 0 | 14 |
| N02 | 1.58 | 2.46 | 7.37 | 0.04 | 0.05 | 0.11 | 0.06 | 0.02 | 0.12 | 0.15 | 10 |
| N03 | 1.58 | 2.46 | 7.37 | 0.04 | 0.05 | 0.11 | 0.06 | 0.02 | 0.12 | 0.3 | 10 |

It can be seen that the alloys labeled S04, S05, S06, N01, N02 and N03 all have a lower (and hence superior) hot cracking index than the 7xx-7 alloy.

Table 2 shows tensile properties for 3 alloy compositions. Best tensile properties were obtained for Alloy N03 which contains 2.46% Mg and 0.3% Sc 2. A preferred alloy thus comprises about 7.37% Zn, about 2.46% Mg, about 1.58% Cu, Si is no more than about 0.04%, Fe is no more than about 0.05%, Mn is no more than about 0.11%, about 0.2% B, about 0.12% Zr, about 0.3% Sc, balance Al.

The shell molds provide a solidification rate of about 0.3 degree/second. The solid molds provide a solidification rate of about 0.08 degree/second. The alloys were solidfied under gas pressure of about 100 psi in the molds. The C-ring shaped alloy castings were aged under two different aging conditions. The first aging condition (Aging practice 1) was at 250 degrees F. for 3 hours. The second aging condition (Aging practice 2) was at 250 degrees F. for 12 hours followed by aging at 310 degrees F. for 3 hours.

Table 3 shows the results of tensile testing of test samples cut from the aged alloy C-ring shaped castings, which are

TABLE 2

Tensile Properties

| | Yield Strength | | Tensile Strength | | | | |
|---|---|---|---|---|---|---|---|
| Alloy | (ksi) | (MPa) | (ksi) | (MPa) | Elongation (%) | Cooling Rate ° C./sec | Casting Process |
| 7xx-7 | — | — | 43 | 296 | — | 1.0 | 0.5" book mold |
| NO2 | 87.1 | 600.5 | 93.3 | 643.5 | 3.0 | 4.5 | Directional |
| | 0.0 | 0.0 | 0.0 | 0.0 | 0.0 | | Solidification |
| | 86.7 | 598.0 | 90.2 | 622.0 | 2.0 | 1.0 | |
| | 0.0 | 0.0 | 86.4 | 595.5 | 1.0 | | |
| | 85.2 | 587.5 | 86.2 | 597.5 | 0.0 | 0.3 | |
| | 0.0 | 0.0 | 84.7 | 584.0 | 1.0 | | |
| NO3 | 85.2 | 587.5 | 90.9 | 626.5 | 6.0 | 4.5 | |
| | 85.0 | 586.0 | 90.5 | 624.0 | 3.0 | | |
| | 84.6 | 583.5 | 90.0 | 620.5 | 3.0 | 1.0 | |
| | 84.3 | 581.0 | 89.0 | 613.5 | 2.0 | | |
| | 80.9 | 558.0 | 83.5 | 575.5 | 1.0 | 0.3 | |
| | 80.3 | 553.5 | 83.7 | 577.0 | 1.0 | | |

designated Melt 1 for alloy 1 and Melt 2 for alloy 2 where ultimate tensile strength, tensile yield strength and percent elongation are shown.

TABLE 3

| Mechanical Properties | | | | | | | |
|---|---|---|---|---|---|---|---|
| | | Shell Mold Process (0.3° C./sec) | | | Solid Mold Process (0.08° C.) | | |
| | | Tensile Strength (ksi) | Yield strength (ksi) | Elongation (%) | Tensile Strength (ksi) | Yield strength (ksi) | Elongation (%) |
| Melt 1 | Aging practice 1 | 79.8 | 70.9 | 4 | 66.4 | 61.8 | 2 |
| | | 74.2 | 69.6 | 2 | 83.7 | 74.7 | 2 |
| | Aging practice 2 | 82.4 | 78.1 | 2 | 62.2 | — | 2 |
| Melt 2 | Aging practice 1 | 75.8 | 70.4 | 4 | 80.8 | 72.7 | 2 |
| | Aging practice 2 | 82.1 | 77.2 | 2 | 73.9 | — | 2 |
| | | 83.6 | 80.5 | 2 | 65.2 | — | 2 |

It is noted that at these high levels of Zn, Mg, and Cu, excellent strenght levels are obtained. The tensile properties indicate that the castings made in the shell molds have higher tensile properties than those made in the solid plaster molds. Due to the very slow cooling rate, the solid molds produced castings with considerable shrinkage porosity, causing a reduction of mechanical properties compared to the castings produced in the shell molds.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

We claim:

1. A shaped cast aluminum alloy product produced from a casting alloy consisting of, in weight percent:

from 4 to 9% Zn;
from 2 to 4% Mg;
from more than 1.0 wt % Cu to 2.5% Cu;
less than 0.1% Si;
less than 0.12% Fe;
less than 0.5% Mn;
from 0.01 to 0.05% B;
less than 0.15% Ti;
from 0.05 to 0.2% Zr;
from 0.1 to 0.5% Sc;
no more than 0.05% each miscellaneous element or impurity;
no more than 0.15% total miscellaneous elements or impurities; and
remainder Al;
wherein the shape cast aluminum alloy product is produced from a casting process consisting of investment casting, permanent mold casting, semi-permanent mold casting, and sand mold casting.

2. The shaped casting aluminum alloy product according to claim 1, wherein a concentration of the Zn is 7.37%.

3. The shaped casting aluminum alloy product according to claim 1, wherein a concentration of the Mg is 2.46%.

4. The shaped casting aluminum alloy product according to claim 1, wherein a concentration of the Cu is 1.58%.

5. The shaped casting aluminum alloy product according to claim 1, wherein a concentration of the Si is no more than 0.04%.

6. The shaped casting aluminum alloy product according to claim 1, wherein a concentration of the Fe is no more than 0.05%.

7. The shaped casting aluminum alloy product according to claim 1, wherein a concentration of the Mn is no more than 0.11%.

8. The shaped casting aluminum alloy product according to claim 1, wherein a concentration of the B is 0.02%.

9. The shaped casting aluminum alloy product according to claim 1, wherein a concentration of the Zr is 0.12%.

10. The shaped casting aluminum alloy product according to claim 1, wherein a concentration of the Sc is 0.3%.

* * * * *